US009559457B2

(12) United States Patent
Strahl

(10) Patent No.: US 9,559,457 B2
(45) Date of Patent: Jan. 31, 2017

(54) ANTI-VIBRATION COUPLING DEVICE

(71) Applicant: Amphenol Corporation, Wallingford, CT (US)

(72) Inventor: Erik Strahl, Unadilla, NY (US)

(73) Assignee: Amphenol Corporation, Wallingford, CT (US)

( * ) Notice: Subject to any disclaimer, the term of this patent is extended or adjusted under 35 U.S.C. 154(b) by 218 days.

(21) Appl. No.: 14/332,704

(22) Filed: Jul. 16, 2014

(65) Prior Publication Data

US 2016/0020552 A1 Jan. 21, 2016

(51) Int. Cl.
*H01R 13/622* (2006.01)
*H01R 13/639* (2006.01)
*H01R 13/533* (2006.01)

(52) U.S. Cl.
CPC ..... *H01R 13/622* (2013.01); *H01R 13/533* (2013.01); *H01R 13/639* (2013.01)

(58) Field of Classification Search
CPC ..... H01R 13/622; H01R 13/639; H01R 13/97; H01R 13/971
USPC ..... 439/321
See application file for complete search history.

(56) References Cited

U.S. PATENT DOCUMENTS 2,728,895 A 12/1955 Quackenbush et al.
3,917,373 A 11/1975 Peterson
4,208,082 A 6/1980 Davies et al.
5,399,096 A 3/1995 Quillet et al.
5,435,760 A 7/1995 Miklos
5,653,605 A * 8/1997 Woehl ..... H01R 13/622 439/321
5,957,716 A 9/1999 Buckley et al.
6,086,400 A * 7/2000 Fowler ..... H01R 13/622 439/321
6,123,563 A 9/2000 Johnson et al.
6,293,595 B1 9/2001 Marc et al.
7,905,741 B1 3/2011 Wade et al.
7,914,311 B1 3/2011 Gallusser et al.
8,579,644 B2 11/2013 Cole et al.

* cited by examiner

*Primary Examiner* — Felix O Figueroa
(74) *Attorney, Agent, or Firm* — Blank Rome LLP; Charles R. Wolfe, Jr.; Tara L. Marcus

(57) ABSTRACT

A coupling device for an electrical connector that includes a connector shell that has a ratchet engagement and an inner coupling member that has actuating end through which the shell extends. An outer surface of the inner member at the actuating end includes a first locking guide. A spring ratchet member is received in a cavity of the inner member and is configured to engage the ratchet engagement of the shell. An outer sleeve is disposed over the inner member and has an inner surface that has a second locking guide that cooperates with the first locking guide and has a decoupling member. Rotating the outer sleeve in a mating direction rotates the inner member in the mating direction, thereby allowing the ratchet member to engage the ratchet engagement of the shell in a one-way ratchet and preventing the inner member from rotating in an unmating direction.

23 Claims, 5 Drawing Sheets

ANTI-VIBRATION COUPLING DEVICE

FIELD OF THE INVENTION

The present invention relates to an anti-vibration coupling device for electrical connector that prevents counter-rotation and loosening of the electrical connector due to vibration when engaged with its mating connector. More specifically, the invention relates to an anti-vibration coupling that self locks and incorporates a decoupling feature allowing manual unlocking of the electrical connector and its mating connector.

BACKGROUND OF THE INVENTION

Electrical connector assemblies generally include mating plug and receptacle connectors. Often a threaded nut or collar is used to mate the plug and receptacle connectors. When an electrical connector assembly is subject to vibration or shock, however, the mating connectors of the assembly often become loose or even decouple. The loosening or decoupling usually occurs because the coupling nut counter rotates, that is it rotates in a direction opposite the mating or locking direction, thereby compromising the integrity of both the mechanical and electrical connection between the plug and receptacle connectors.

Examples of some prior art couplings for electrical connector assemblies include U.S. Pat. No. 8,579,644 to Cole et al.; U.S. Pat. No. 7,914,311 to Gallusser et al.; U.S. Pat. No. 7,905,741 to Wade et al., U.S. Pat. No. 6,293,595 to Marc et al; U.S. Pat. No. 6,123,563; U.S. Pat. No. 6,086,400 to Fowler; U.S. Pat. No. 5,957,716 to Buckley et al.; U.S. Pat. No. 5,435,760 to Miklos; U.S. Pat. No. 5,399,096 to Quillet et al.; U.S. Pat. No. 4,208,082 to Davies et al.; U.S. Pat. No. 3,917,373 to Peterson; and U.S. Pat. No. 2,728,895 to Quackenbush, the subject matter of each of which is hereby incorporated by reference A need exists for a simplified anti-vibration coupling device that both prevents loosening of the mated plug and receptacle but also provides a mechanism for easily decoupling the plug and receptacle when desired.

SUMMARY OF THE INVENTION

Accordingly, the present invention provides a coupling device for an electrical connector that comprises a connector shell that has first and second ends and a ratchet engagement between the first and second ends, and an inner coupling member rotatably coupled to the connector shell, that has an actuating end through which the first end of the connector shell extends. The actuating end of the inner coupling member defines a cavity and an outer surface of the coupling device at the actuating end including at least one first locking guide. A spring ratchet member is received in the cavity of the inner coupling member and is configured to engage the ratchet engagement of the connector shell. An outer sleeve is disposed over the inner coupling member. The outer sleeve has an inner surface with at least one second locking guide that cooperates with the at least one first locking guide of the inner coupling member to rotate the inner coupling member in a mating direction and an unmating direction opposite the mating direction. The inner surface of the outer sleeve has at least one decoupling member. Rotating the outer sleeve in the mating direction rotates the inner coupling member in the mating direction with respect to the connector shell, thereby allowing the spring ratchet member to engage the ratchet engagement of the connector shell in a one-way ratchet and preventing the inner coupling member from rotating in the unmating direction.

The present invention may also provide a coupling device for an electrical connector that comprises a connector shell that has first and second ends and a plurality of ratchet teeth disposed on an outer surface of the connector shell between the first and second ends, and a coupling nut rotatably coupled to the connector shell. The coupling nut has an actuating end through which the first end of the connector shell extends and the actuating end defines a cavity. An outer surface of the coupling nut at the actuating end includes a recessed portion that forms a first locking guide. A spring ratchet member is received in the cavity of the coupling nut and includes at least one spring arm configured to engage the plurality of ratchet teeth of the connector shell. A decoupling sleeve is disposed over the coupling nut. The decoupling sleeve has an inner surface with a spline that forms a second locking guide that cooperates with the first locking guide of the coupling nut to rotate the coupling nut in a mating direction and an unmating direction opposite the mating direction. The inner surface of the decoupling sleeve has a ramp that forms a decoupling member. Rotating the decoupling sleeve in the mating direction rotates the coupling nut in the mating direction with respect to the connector shell, thereby allowing the spring arm of the spring ratchet member to engage the ratchet teeth of the connector shell in a one-way ratchet and preventing the coupling nut from rotating in the unmating direction, and rotating the decoupling sleeve in the unmating direction engages the ramp of the decoupling sleeve with the spring arm of the spring ratchet member, thereby releasing the spring arm and allowing the coupling nut to rotate in the unmating direction.

With those and other objects, advantages, and features of the invention that may become hereinafter apparent, the nature of the invention may be more clearly understood by reference to the following detailed description of the invention, the appended claims, and the several drawings attached herein.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE EXEMPLARY EMBODIMENTS

Figure 1:
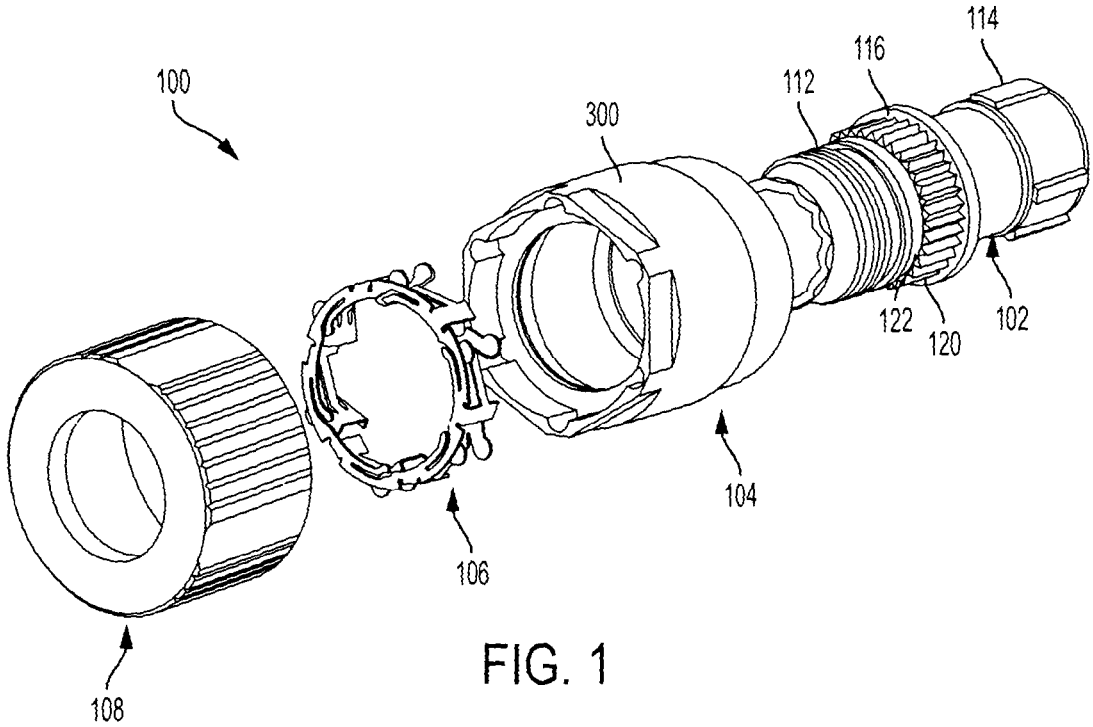
FIG. 1 is an exploded perspective view of an anti-vibration coupling device according to an exemplary embodiment of the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents that operate in similar manner to accomplish a similar purpose. Several preferred embodiments of the invention are described for illustrative purposes, it being understood that the invention may be embodied in other forms not specifically shown in the drawings.

Referring to FIGS. 1, 2, 3*a*, 3*b*, 4*a*, 4*b*, 5, 6*a* and 6*b*, the present invention relates to an anti-vibration coupling device 100 for an electrical connector assembly, such as a plug and receptacle assembly. The coupling device 100 preferably provides a positive locking one-way ratchet engagement such that the connectors of the assembly can only be decoupled manually The ratchet engagement of the present invention substantially prevents the components of the connector assembly from becoming loose, particularly during vibration. The coupling 100 generally includes a connector shell 102, an inner coupling member 104 rotatably coupled to the shell 102, a ratchet member 106, and an outer sleeve 108 for decoupling the device, as seen in FIG. 1.

The connector shell 102 generally includes first and second ends 112 and 114 with a retention shoulder 116 therebetween, as seen in FIG. 1. The first end 112 may include outer threads for engaging a cable or cable accessory. The second end 114 is adapted to mate with a connector or connector component. Incorporated in the connector shell 102 is a ratchet engagement 120 configured to engage the ratchet member 106. The ratchet engagement 120 may be a plurality of ratchet teeth disposed on the outer surface 122 of the connector shell 102, preferably located adjacent to the retention shoulder 116. The teeth 120 are preferably arranged as an annular continuous ring around the connector shell 102. However, the teeth 120 may be arranged in segments or a discontinuous ring as long as the teeth 120 are capable of engaging the ratchet member 106.

Figure 2:
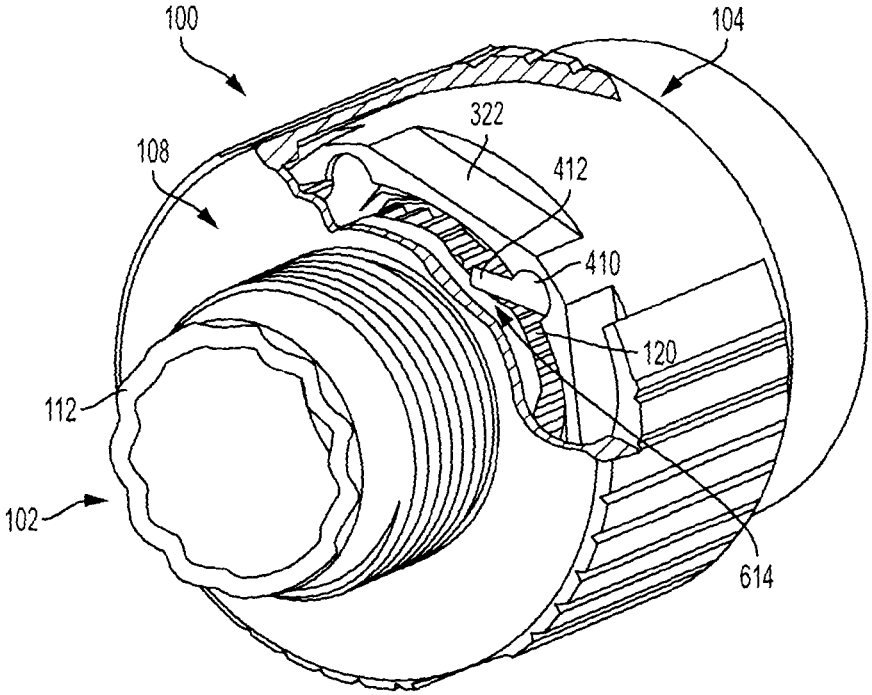
FIG. 2 is a perspective view of the anti-vibration coupling device illustrated in FIG. 1, showing the device assembled and with a portion of an outer sleeve of the device removed.
Figure 3A:
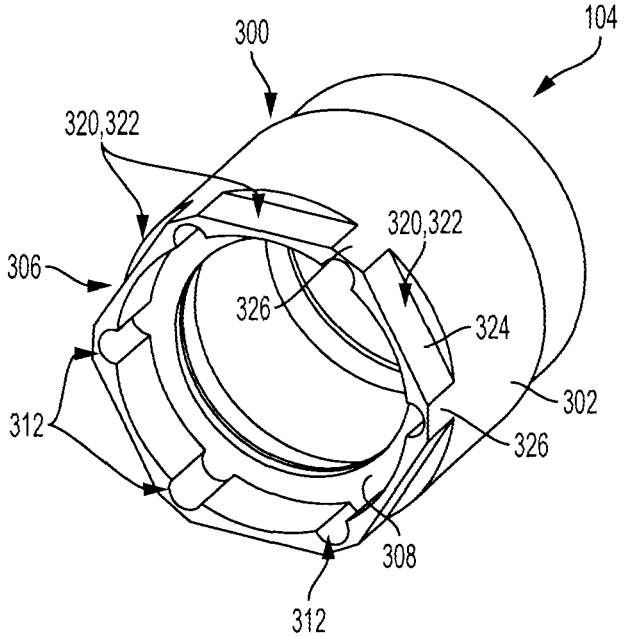
FIG. 3*a* is a perspective view of an inner coupling member of the anti-vibration device illustrated in FIG. 1.
Figure 3B:
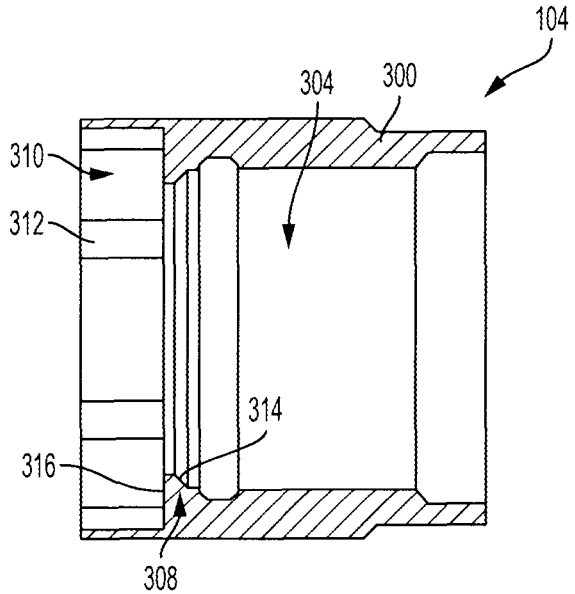
FIG. 3*b* is a cross-sectional view of the inner coupling member illustrated in FIG. 3*a;*

The connector shell 102 is received in the inner coupling member 104, such that the first end 112 of the shell 102 is exposed, as seen in FIG. 2. The inner coupling member 104 and the connector shell 102 are rotatably coupled. The inner coupling member 104 is preferably a nut that includes a main body 300 with an outer surface 302 and an inner bore 304 that accepts the connector shell 102, as seen in FIGS. 2 and 3*a*. The main body 300 includes an actuating end 306 and an inner annular shoulder 308 that is recessed from the actuating end 306, thereby defining a cavity 310 (FIG. 3*b*) configured to receive the ratchet member 106. One or more longitudinal channels 312 may be provided in the cavity 310 that are preferably uniformly spaced from one another around the inner surface of the actuating end 306. The inner annular shoulder 308 includes a shell side surface 314 that catches the retention shoulder 116 of the connector shell 102 when the shell 102 is extended through the inner bore 304 of the nut 104. The side surface 316 of the annular shoulder 308 that is opposite the shell side surface 314 abuts or is adjacent to the ratchet member 106 when it is received in the nut's cavity 310.

On the outer surface 302 at the actuating end 306 of the out 104 may be one or more locking guides 320 that cooperate with the outer decoupling sleeve 108, as seen in FIGS. 2 and 3*a*. Each locking guide 320 is preferably a recessed area 322 that includes a substantially flat engagement surface 324. The recessed areas 322 may be spaced around the outer surface 302 at the actuating end 306 of the nut 104 with stops 326 therebetween. The location of the stops 326 preferably coincide with the location of the channels 312, as best seen in FIG. 3*a*. The distance between the stops 326 defines the amount of rotation between the nut 104 and the outer decoupling sleeve 108.

Figure 4A:
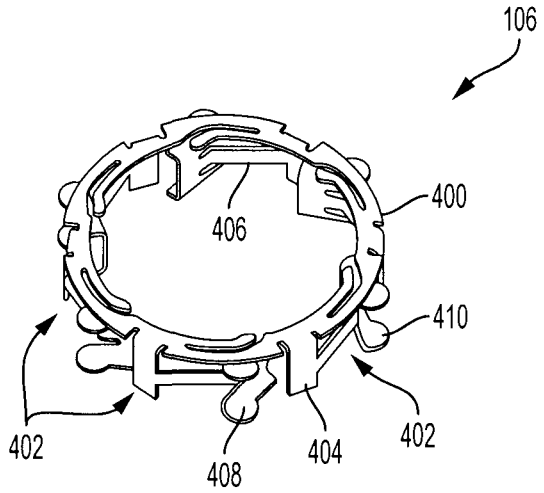
FIG. 4*a* is a perspective view of a ratchet member of the anti-vibration coupling device illustrated in FIG. 1.
Figure 4B:
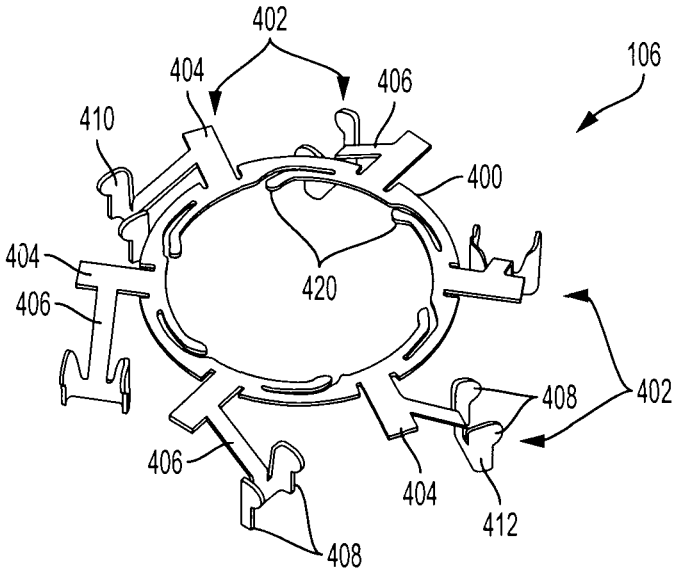
FIG. 4*b* is a perspective view of the ratchet member illustrated in FIG. 4*a*, showing the ratchet member before being stamped into its final form of FIG. 4*a;*

The ratchet member 106 may be formed of stamp metal. As seen in FIGS. 4*a* and 4*b*, the ratchet member 106 generally includes a main ring body 400 designed to fit over the connector shell 102 and one or more spring arms 402 designed to engage the shell's ratchet teeth 120. The ring body 400 is preferably a substantially flat ring with the spring arms 402 extending from the circumference thereof, as seen in FIG. 4*a*. The spring arms 402 are preferably evenly spaced around the ring body 400.

Figure 5:
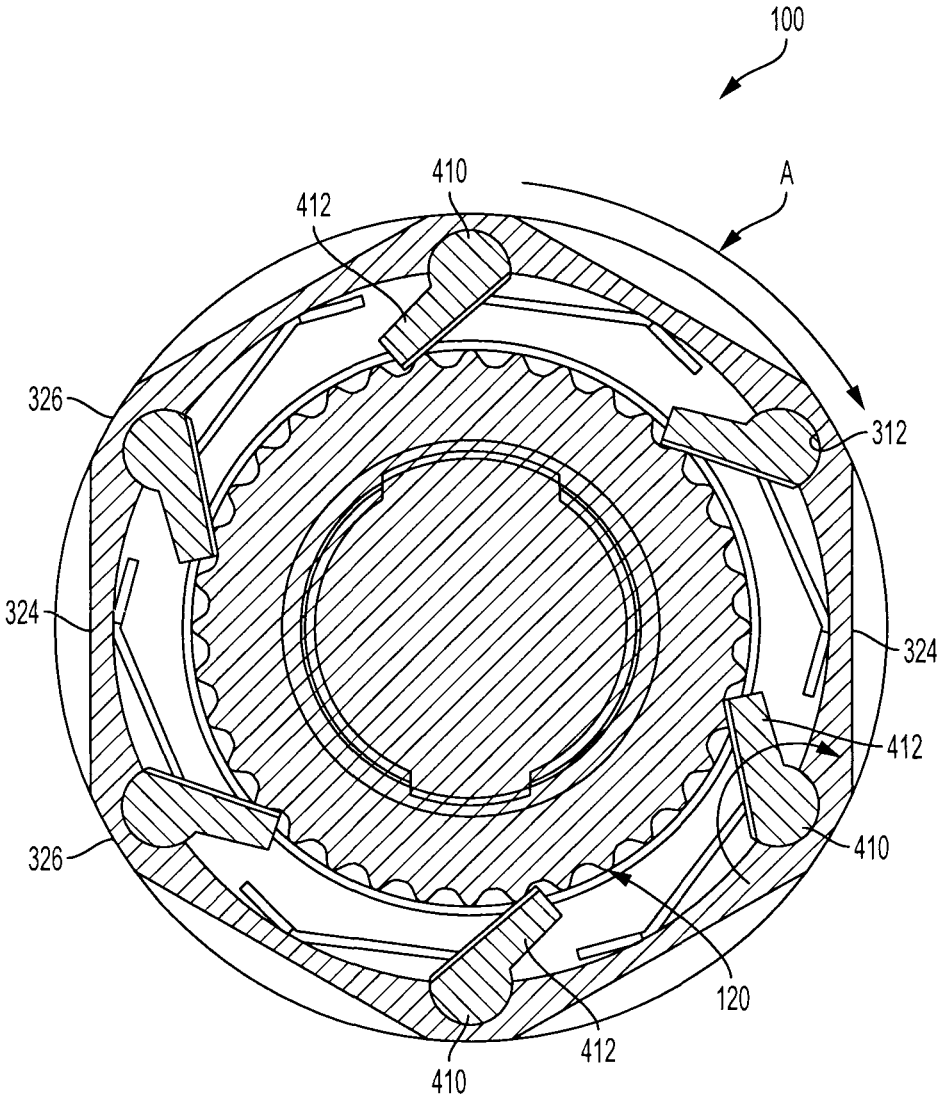
FIG. 5 is a cross-sectional end view of the anti-vibration coupling member illustrated in FIG. 1, showing the device without the outer sleeve.

Each spring arm 402 may include an extension 404 extending from the ring body 400, a carrier strip 406 extending from the extension 404, and one or more pawls 408 at the end of the carrier strip 406. When the ratchet member 106 is received in the cavity of the nut 104, the spring arm extensions 404 extend toward the nut's inner shoulder 308 generally perpendicular to the ring body 400. Each carrier strip 406 connects the pawls 408 and the extensions 404. Each carrier strip 406 slopes slightly inwardly toward the center of the ring body 400 such that the pawls 408 are also angled inward, as seen in FIG. 4*b*. Preferably, a pair of the pawls 408 that are spaced opposite one another are disposed at the end of each carrier strip 406. Each pawl 408 preferably has a rounded head 410 that engages the nut, in particular, one of the channels 312 of the nut 104, and a tail end 412 that engages the ratchet teeth 120 of the connector shell 102. The spring arms 402 are flexible and elastic which allows the pawls 408 to pivot in the channels 312 which in turn allows the tail ends 412 to ride over the ratchet teeth 120 when turning the nut 104 in the mating direction A during mating, as seen in FIG. 5. The carrier strips 406 are configured to bias the pawls 408 to a neutral position such that they are driven against the teeth on the plug shell 120.

Secondary spring elements 420 may be provided extending from the inner diameter of the ring body 400 to limit arbitrary movement of the decoupling sleeve 108 to the nut 104 by latching over decoupling members 614. The secondary spring elements 420 may be formed as cutouts in the ring body 400, as seen in FIG. 4*a*.

The outer decoupling sleeve 108 is disposed over the nut 104, as seen in FIG. 2, and functions to actuate the nut 104 in both the mating direction A and unmating direction opposite the mating direction A. The outer sleeve 108 includes inner and outer surfaces 602 and 604 where the outer surface 604 may include gripping members 606, such as grooves. The inner surface 604 includes one or more locking guides 620 that cooperate with the locking guides 320 of the nut 104. The locking guides 620 are preferably splines 622 that engage the recessed areas 322 of the nut. The engagement of the nut's recessed areas 322 and the sleeve's splines 622 serve both to limit the amount of rotation between the sleeve 108 and the nut 104 and to transmit mating and unmating torque to the nut 104 as the splines 622 move between the stops 326 of the nut 104.

Figure 6A:
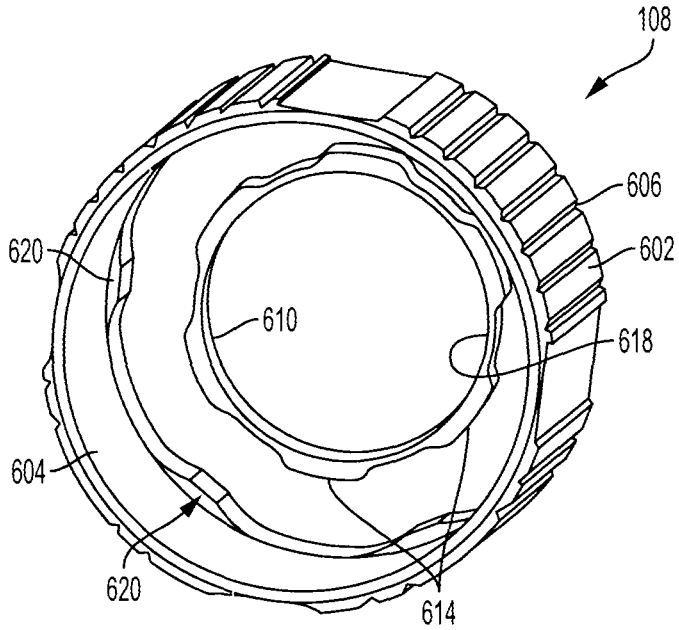
FIG. 6*a* is a perspective view of the outer sleeve of the anti-vibration coupling member illustrated in FIG. 1.
Figure 6B:
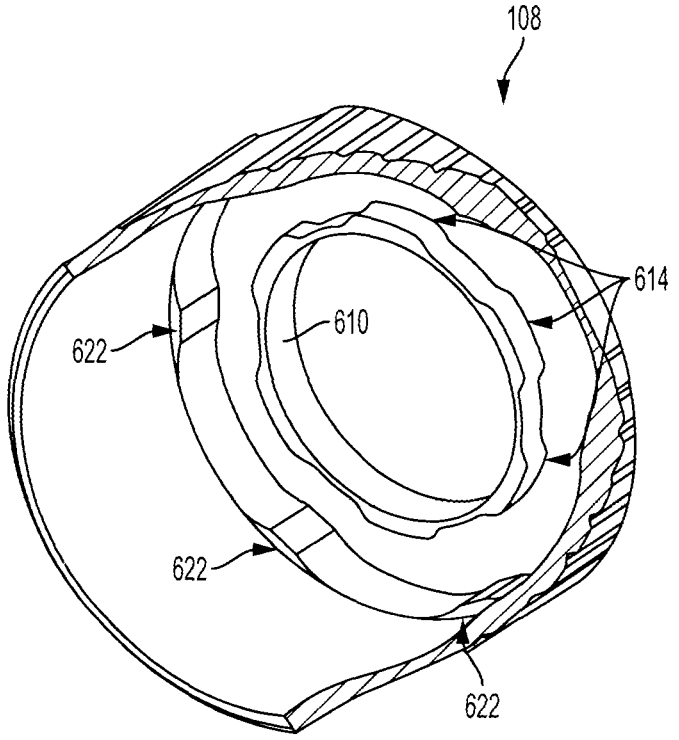
FIG. 6*b* is perspective cutaway view of the outer sleeve illustrated in FIG. 6*a*, showing a portion of the outer sleeve removed.

As seen in FIG. 6*b*, the outer sleeve 108 includes a shortened annular wall 610 spaced from the inner surface 602. The annular wall 610 extends longitudinally from an end wall 612 of the sleeve 108. The annular wall 610 preferably includes one or more decoupling members 614 configured to engage the spring arms 402 of the ratchet member 106 when unmating the coupling nut, as seen in FIG. 2. Each decoupling member 614 is preferably a ramp extending radially outwardly from the annular wall 610, as seen in FIG. 6*b*. The annular wall 610 defines an opening 618 in the end wall 612 that receives the first end 112 of the connector shell 102. When the decoupling sleeve 108 is received on the nut 104, the spring ratchet member 106 is captured between the sleeve's end wall 612 and the cavity 310 of the nut 104 and resides around the annular wall 610 such that the ramps 614 are positioned underneath the pawl tails ends 412 of the spring arms 402 of the ratchet member 106. The distance between the pair of pawls 408 of each ratchet spring arm 402 is preferably of sufficient length to allow the tail ends 412 of the pawls 408 to rest on and contact both the ratchet teeth 120 of the connector shell 102 and the ramps 614 of the outer sleeve 108.

In operation the outer sleeve 108 may be rotated in a mating direction with respect to the connector shell 102 such that the sleeves splines 622 engage the recessed areas 322, respectively, of the nut 104 until the splines 622 catch on the nut's stops 324, thereby rotating the nut 104 in the mating direction. While the nut 104 is being rotated in the mating direction by the sleeve 108, the tail ends 412 of the ratchet springs arms 402 ride over the ratchet teeth 120 of the connector shell 102 and the heads 410 of the pawls 408 pivot in the channels 312, respectively, of the nut 104. That allows the end 112 of the shell to rotate and engage a mating component.

Because of the ratchet engagement between the shells' teeth 102 and the spring ratchet member 106, the nut 104 is prevented from rotating in the opposite unmating direction even during conditions, such as vibration. In order to unmate the shell 102 from its mating component, the decoupling sleeve 108 is rotated in the unmating direction such that the ramps 614 on the annular wall 610 lift the tail ends 412 of the ratchet spring arms 402, thereby clearing the shell's ratchet teeth 120 and allowing the nut 104 to rotate in the unmating direction.

The foregoing description and drawings should be considered as illustrative only of the principles of the invention. The invention may be configured in a variety of shapes and sizes and is not intended to be limited by the preferred embodiment. Numerous applications of the invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

Although certain presently preferred embodiments of the disclosed invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. A coupling device for an electrical connector, comprising:

a connector shell having first and second ends and a ratchet engagement between said first and second ends;

an inner coupling member rotatably coupled to said connector shell, said inner coupling member having an actuating end through which said first end of said connector shell extends, said actuating end of said inner coupling member defining a cavity, and an outer surface of said inner coupling member at said actuating end including at least one first locking guide;

a spring ratchet member received in said cavity of said inner coupling member and configured to engage said ratchet engagement of said connector shell, said spring ratchet member including a ring main body and at least one spring arm, said at least one spring arm including at least one pawl, and said pawl pivots as said outer sleeve and said inner coupling member rotate in the mating direction; and an outer sleeve disposed over said inner coupling member, said outer sleeve having an inner surface with at least one second locking guide that cooperates with said at least one first locking guide of said inner coupling member to rotate said inner coupling member in a mating direction and an unmating direction opposite the mating direction, and said inner surface of said outer sleeve having at least one decoupling member, wherein rotating said outer sleeve in the mating direction rotates said inner coupling member in the mating direction with respect to said connector shell, thereby allowing said spring ratchet member to engage said ratchet engagement of said connector shell in a one-way ratchet and preventing said inner coupling member from rotating in the unmating direction.

2. A coupling device according to claim 1, wherein said ratchet engagement is a plurality of teeth disposed on an outer surface of said connector shell.

3. A coupling device according to claim 2, wherein said plurality of teeth form a continuous ring around said outer surface.

4. A coupling device according to claim 1, wherein said cavity of said inner coupling member is defined by an inner annular shoulder.

5. A coupling device according to claim 1, wherein said at least one first locking guide is a recessed portion on said outer surface of said inner coupling member, said recessed portion has a substantially flat engagement surface for engaging said at least one second locking guide.

6. A coupling device according to claim 1, wherein said inner coupling member includes at least one channel at said actuating end that is configured to accept a head portion of said at least one pawl.

7. A coupling device according to claim 6, wherein said pawl includes a tail portion opposite said head portion, said tail portion engages said ratchet engagement of said connector shell.

8. A coupling device according to claim 1, wherein at least one secondary spring element extends from an inner diameter of said ring main body.

9. A coupling device according to claim 1, wherein said at least one second locking guide is a spline disposed on said inner surface of said outer sleeve.

10. A coupling device according to claim 1, wherein said outer sleeve includes an inner annular wall that carries said at least one decoupling member, said inner wall is spaced from an outer wall of said outer sleeve.

11. A coupling device according to claim 10, wherein said decoupling member is a ramp configured to engage said spring ratchet member when said outer sleeve is rotated in the unmating direction.

12. A coupling device according to claim 1, wherein said outer sleeve includes an outer gripping surface.

13. A coupling device for an electrical connector, comprising a connector shell having first and second ends and a plurality of ratchet teeth disposed on an outer surface of said connector shell between said first and second ends;

a coupling nut rotatably coupled to said connector shell, said coupling nut having an actuating end through which said first end of said connector shell extends, said actuating end of said coupling nut defining a cavity, and an outer surface of said coupling nut at said actuating end including a recessed portion forming first locking guide;

a spring ratchet member received in said cavity of said coupling nut, said spring ratchet member including a ring main body and a plurality of spring arms extending therefrom arm configured to engage said plurality of ratchet teeth of said connector shell, each of said spring arms including at least one pawl, and said pawl pivots as said decoupling sleeve and said coupling nut rotate in the mating direction; and a decoupling sleeve disposed over said coupling nut, said decoupling sleeve having an inner surface with a spline forming a second locking guide that cooperates with said first locking guide of said coupling nut to rotate said coupling nut in a mating direction and an unmating direction opposite the mating direction, and said inner surface of said decoupling sleeve having a ramp forming a decoupling member, wherein rotating said decoupling sleeve in the mating direction rotates said coupling nut in the mating direction with respect to said connector shell, thereby allowing said spring arm of said spring ratchet member to engage said ratchet teeth of said connector shell in a one-way ratchet and preventing said coupling nut from rotating in the unmating direction, and wherein rotating said decoupling sleeve in the unmating direction engages said ramp of said decoupling sleeve with said spring arm of said spring ratchet member, thereby releasing said spring arm and allowing said coupling nut to rotate in the unmating direction.

14. A coupling device according to claim 13, wherein said plurality of teeth form a continuous ring around said outer surface of said connector shell.

15. A coupling device according to claim 13, wherein said recessed portion that forms said first locking guide has a substantially flat engagement surface for engaging said spline that forms said second locking guide.

16. A coupling device according to claim 13, wherein said coupling nut includes a plurality of channels at said actuating end, each of said channels is configured to accept one of said pawls.

17. A coupling device according to claim 13, wherein each of said pawls includes a head portion and a tail portion opposite said head portion, said tail portion engages said ratchet teeth of said connector shell.

18. A coupling device according to claim 13, wherein a plurality of secondary spring elements extends from an inner diameter of said ring main body.

19. A coupling device according to claim 13, wherein said decoupling sleeve includes an inner annular wall that carries said ramp that forms said decoupling member, said inner wall is spaced from an outer wall of said dcoupling sleeve.

20. A coupling device according to claim 13, wherein said outer sleeve includes an outer gripping surface.

21. A coupling device according to claim 13, wherein said spring ratchet member is formed of stamped metal.

22. A coupling device for an electrical connector, comprising:

a connector shell having first and second ends and a ratchet engagement between said first and second ends;

an inner coupling member rotatably coupled to said connector shell, said inner coupling member having an actuating end through which said first end of said connector shell extends, said actuating end of said inner coupling member defining a cavity, and an outer surface of said inner coupling member at said actuating end including at least one first locking guide;

a spring ratchet member received in said cavity of said inner coupling member and configured to engage said ratchet engagement of said connector shell, said spring ratchet member including a ring main body and at least one spring arm, and at least one secondary spring element extends from an inner diameter of said ring main body; and an outer sleeve disposed over said inner coupling member, said outer sleeve having an inner surface with at least one second locking guide that cooperates with said at least one first locking guide of said inner coupling member to rotate said inner coupling member in a mating direction and an unmating direction opposite the mating direction, and said inner surface of said outer sleeve having at least one decoupling member, wherein rotating said outer sleeve in the mating direction rotates said inner coupling member in the mating direction with respect to said connector shell, thereby allowing said spring ratchet member to engage said ratchet engagement of said connector shell in a one-way ratchet and preventing said inner coupling member from rotating in the unmating direction.

23. A coupling device for an electrical connector, comprising:

a connector shell having first and second ends and a plurality of ratchet teeth disposed on an outer surface of said connector shell between said first and second ends;

a coupling nut rotatably coupled to said connector shell, said coupling nut having an actuating end through which said first end of said connector shell extends, said actuating end of said coupling nut defining a cavity, and an outer surface of said coupling nut at said actuating end including a recessed portion forming first locking guide;

a spring ratchet member received in said cavity of said coupling nut, said spring ratchet member including a ring main body and a plurality of spring arms extending therefrom configured to engage said plurality of ratchet teeth of said connector shell, and a plurality of secondary spring elements extending from an inner diameter of said ring main body; and a decoupling sleeve disposed over said coupling nut, said decoupling sleeve having an inner surface with a spline forming a second locking guide that cooperates with said first locking guide of said coupling nut to rotate said coupling nut in a mating direction and an unmating direction opposite the mating direction, and said inner surface of said decoupling sleeve having a ramp forming a decoupling member, wherein rotating said decoupling sleeve in the mating direction rotates said coupling nut in the mating direction with respect to said connector shell, thereby allowing said spring arm of said spring ratchet member to engage said ratchet teeth of said connector shell in a one-way ratchet and preventing said coupling nut from rotating in the unmating direction, and wherein rotating said decoupling sleeve in the unmating direction engages said ramp of said decoupling sleeve with said spring arm of said spring ratchet member, thereby releasing said spring arm and allowing said coupling nut to rotate in the unmating direction.

* * * * *